United States Patent [19]

Satzinger

[11] 4,290,561

[45] Sep. 22, 1981

[54] REEL FOR THE UNREELING OF TAPES OR THE LIKE

[75] Inventor: Roland Satzinger, Euerdorf, Fed. Rep. of Germany

[73] Assignee: Gebhardt Satzinger Metallwarenfabrik, Bad Kissingen, Fed. Rep. of Germany

[21] Appl. No.: 30,508

[22] Filed: Apr. 16, 1979 (Under 37 CFR 1.47)

[30] Foreign Application Priority Data

Apr. 14, 1978 [DE] Fed. Rep. of Germany ..... 2816179

[51] Int. Cl.[3] ..... B65H 75/02; B21C 47/16

[52] U.S. Cl. ..... 242/55; 242/78.6

[58] Field of Search ..... 242/55, 67.1 R, 67.3 R, 242/76, 78.6, 78.7

[56] References Cited

U.S. PATENT DOCUMENTS

| | | | |
|---|---|---|---|
| 2,417,818 | 3/1947 | Finn | 242/54 R |
| 2,664,250 | 12/1953 | Friedman | 242/54 R |
| 3,282,518 | 11/1966 | Holmes | 242/54 R |
| 3,933,322 | 1/1976 | Satzinger | 242/78.6 X |

*Primary Examiner*—Edward J. McCarthy

*Attorney, Agent, or Firm*—Sprung, Felfe, Horn, Lynch & Kramer

[57] ABSTRACT

An improvement in an apparatus for unreeling tapes and the like which apparatus comprises a reel plate driven by a driving motor, said driving motor having a driving shaft provided with a driven wheel, said driven wheel connected via a transmission to a driving wheel, said driving wheel connected via a shaft to said reel plate, said driven wheel connected to a clutch, said clutch connected to an actuating feeler said feeler engageable by tape unwound from a reel disposed on said reel plate whereby when said feeler is engaged said clutch is engaged to transmit rotation of said driven wheel to said driving wheel through said transmission.

10 Claims, 3 Drawing Figures

REEL FOR THE UNREELING OF TAPES OR THE LIKE

BACKGROUND OF THE INVENTION

1. Field of the Invention

The present invention concerns a reel for the unreeling of tapes or the like from a reel plate with a drive motor for the reel plate, a gear, the driven wheel of which is arranged on the driving shaft of the motor and the driving wheel of which is arranged on the shaft of the reel plate, interposed between drive motor and reel plate, and with a clutch interposed between drive motor and reel plate and controlled through a linkage by the unreeled tape.

2. Discussion of the Prior Art

Unreeling reels, which have the purpose of unreeling tape material or the like reeled up in coils or reels and to feed this to a following processing machine, are already known in different constructions. With small coil weights, these reels are mostly equipped without special drives and the material tape is then frequently drawn off directly by the tape advance provided on the processing machine. This procedure cannot be employed for greater tape weights. Special measures are required here so that the tape runs off at constant speed. A direct and uncontrolled drive of the reel plate does not come into question there, because the diameter of the coil after all continuously reduces so that the tape speed becomes ever greater at constant rotational speed of the reel plate. For this reason, it is known to provide drives for the reel plate, which comprises special regulating equipments of mechanical, optical or electronic kind which, through scanning, effect a regulation to constant tape speed. These drives and controls are complicated in construction, require a high additional effort and still have the disadvantages that they render the operation of the machine more difficult and are above all very susceptible to faults in rough operation.

Through the U.K. Patent Specification No. 710,263, there has become known a tape reeling equipment with a drive motor, a reeling capstan, a gear for torque transmission and a clutch, which is interposed between drive motor and reeling capstan and which is controlled and actuated through a linkage articulated to the machine frame and a tightening roller standing in contact with the tape to be reeled up. The tape, to be reeled up and guided over several feed and deflecting rollers, is conducted in a tape loop in front of the reeling capstan arranged with horizontal rotational axes over a tensioning roller, which is held at both sides by a respective angle lever pivotable around a point on the machine frame. A lever system with interposed spring engages one of the angle levers and (according to FIG. 4) actuates a disc friction coupling placed on the driven shaft for the reeling capstan. The one disc of the friction coupling, which is journalled to be freely rotatable on a projecting end of the driven shaft for the reeling capstan, is connected rotationally fast with a chain wheel which is driven through a chain by an electrical motor. The other disc of the friction coupling is connected rotationally fast with the projecting end of the driven shaft, journalled in the machine frame, for the reeling capstan. Engaging into the end of the driven shaft facing the reeling capstan and provided with a central bore at the end face is the exchangeable shaft, provided with a correspondingly developed spigot, of the reeling capstan, while the transmission of the torque takes place through pins protruding at the end face and engaging into corresponding bores. The shaft of the reeling capstan at the other end is likewise provided with a protruding spigot which engages into the bore of an axially displaceable rolling bearing journalled in a bush fastened in the machine frame. This construction is necessary to be able to insert and remove the reeling capstan.

This known construction is relatively expensive and complicated, for which the high constructional effort on the one hand and also the great operating effort on the placing-on or removal of the material coil on the other hand is to be mentioned. Resulting from the plurality of the individual parts is also a greater susceptibility to faults, which is very disadvantageous particularly in rough operation. Beyond that, also the chain as well as the coupling disc connected with the driving chain wheel in this known construction rotates together with the driving motor also in the uncoupled state, which signifies higher performance losses.

The present invention has set itself the task of providing a reel with less effort in construction and in the operation, which operates reliably and free of trouble even in rough operation and above all keeps the performance losses low in idling of the motor.

SUMMARY OF THE INVENTION

Broadly, the invention comprises an improvement in an apparatus for unreeling tapes and the like which apparatus comprises a reel plate driven by a driving motor, said driving motor having a driving shaft provided with a driven wheel, said driven wheel connected via a transmission to a driving wheel, said driving wheel connected via a shaft to said reel plate, said driven wheel connected to a clutch, said clutch connected to an actuating feeler, said feeler engageable by tape unwound from a reel disposed on said reel plate whereby when said feeler is engaged, said clutch is engaged to transmit rotation of said driven wheel to said driving wheel through said transmission.

Through the arrangement of the driven wheel of the gear, the clutch and the actuating device for these on the driving shaft of the motor, all essential parts of the control of the drive are comprised at one location. Thereby, the constructional build-up is simplified and a simpler assembly and disassembly of these parts themselves is attained. The reel plate singly and only is connected with the driving wheel of the gear so that its arrangement and journalling can be structured to be substantially simpler. Through the arrangement of the clutch on the driving shaft of the motor, the gear is uncoupled from the driving motor in idling, so that its performance losses are small. The motor, preferably a normal electrical motor, in the operationally ready state of the reel circulates constantly at constant rotational speed, which is preferably slightly greater than the rotational speed which corresponds to the tape speed at the inner diameter of the material coil. Thereby, a continuous switching on and off of the motor is avoided so that the life duration of the motor and the switching equipments is not influenced negatively. The switching equipment can thus be constructed as simply as possible. When material is required by the processing machine, the clutch controlled by the tape engages and connects the motor with the reel plate so that tape is reeled off. When sufficient tape is in front of the processing machine, the clutch is released and the reel plate runs on without drive, while tape is reeled off still further.

The control of the clutch takes place through a feeler or the like, which engages at the tape running off from the reel plate, for example at the tape loop between reel and processing machine, and which is connected with the actuating device for the clutch. In place of the feeler, a deflecting roller for the tape can also serve for actuation of the clutch. The tape loop in that case moves the feeler upwardly or downwardly, wherein for example on a motion upwardly, i.e., reduction of the tape loop and thereby of the tape supply in front of the processing machine, the clutch is engaged and the reel plate thereby set into rotary motion so that tape runs off. In the case of the arrangement of a deflecting roller, this is changed in its position by the tape running off and in that case actuates the coupling.

Since the rotational speed of the motor and thereby also of the reel plate is slightly greater than corresponds to the tape speed at the inner diameter of the material coil, more tape material is always reeled off than is required by the processing machine. A greater tape loop thus again forms between reel and processing machine, while the feeler moves downwardly and thereby opens the clutch through the lever system and the actuating device and thereby interrupts the drive for the reel plate though the motor continues to run at the same rotational speed and in itself does not need to be switched off. The reel plate now circulates without drive and is braked slowly only by the bearing friction. When tape supply again reduces, then the shortening tape loop actuates the clutch anew and the reel plate is again brought into operative connection with the motor.

Due to the fact that the motor rotates continuously, its starting torque is relatively small during the starting-up of the, in some circumstances, very heavy reel plate with material coil and the clutch connects motor and reel plate rapidly, but very softly and with uniform acceleration, i.e., jerk-free. The motor can thus accelerate greater masses with the same nominal performance, thus manage greater coil weights and/or higher tape speeds.

By reason of the drive of the reel plate through a gear, a connection between the driving shaft of the motor and the driving wheel loosely arranged thereon (in the uncoupled state), i.e., freely rotating, is created in simple manner. The space requirement of this solution is relatively small. To by understood under the general expression "gears" are not only spur wheel gears, but also others such as belt or chain drives and so forth. The driving wheel can therefore be a spur wheel, however also a belt pulley or the like. It has proved particularly advantageous to construct the clutch according to claim 4 as slipping clutch, wherein this slipping clutch continuously slips in continuous operation. This has the advantage that, since the rotational speed of the motor and thereby of the reel plate couled therewith is after all greater than corresponds to the tape speed, a matching to the exact consumption takes place through the slipping of the clutch. The slipping clutch is brought into engagement by the actuating device controlled by the feeler so far that the reel plate sets itself exactly to the tape consumption and in that case rotates at the rotational speed which is necessary according to the instantaneous diameter of the material coil. Thereby, the control of the material supply in front of the processing machine, i.e., the tape loop, is substantially simplified, while the "switching frequency" of the clutch and also the brake becomes relatively small. An extremely uniform tape unreeling is thereby assured, while only small acceleration forces arise. The slipping clutch is furthermore very well suited to make rapid accelerations possible with jerk-free motions. An almost uniformly running tape loop is attained in this manner. This is a main condition for the trouble-free function of the reel at high processing speeds. Particularly advantageous refinements of this slipping clutch and of the actuating device bringing this slipping clutch into action are described herein. A plate actuating mechanism described below is simple in structure, but extremely effective, for which already smallest deflections of the feeler lever produce a large pressing force for the coupling parts. Thereby, additional servo-controls and the like, which in turn would increase the danger of an early failure and thereby standstill of the reel and of the processing machine, can be dispensed with. This plate can bear directly or with the interposition of bearings and spacer washers against the shoulder and the axially displaceable part of the coupling.

For the case that the processing machine is suddenly stopped and/or the tape loop becomes too great through other influences, a brake, likewise controlled by the feeler, can be provided for the reel plate. This brake comes into action when the tape supply in front of the processing machine has exceeded a certain value, for which the clutch in that case is opened at the same time. Conversely, the brake must be opened when the coupling again engages due to the reducing tape supply.

The following advantages are attained by the apparatus according to the invention:

Use of a simple motor running without interruptions at the same rotational speed.

Omission of complicated electrical switching and control equipment and thereby of particularly susceptible fault sources.

No irregular loadings of switching relays or the like, which appreciably reduce the life duration by frequent switchings.

Simple yet effective clutch, by which the reel plate is brought exactly to the rotational speed which corresponds to the instantaneous diameter of the tape to be reeled off, thus the actual tape comsumption.

Smooth starting-up of the reel with uniform acceleration at start of work and in operation.

Small load comsumption, because the motor is already at nominal rotational speed when reel plate must be driven.

Only small losses in operation due to friction in the brearings and driving elements.

Uniformly running tape so that a trouble-free function is assured even at high processing speeds.

Small control forces which can be exerted solely by the tape running off without servo-equipments.

Altogether simpler and uncomplicated build-up as well as a simple operation.

BRIEF DESCRIPTION OF DRAWINGS

An example of embodiment of the invention is illustrated in the accompanying drawings, in which.

DESCRIPTION OF SPECIFIC EMBODIMENT

Figure 1:
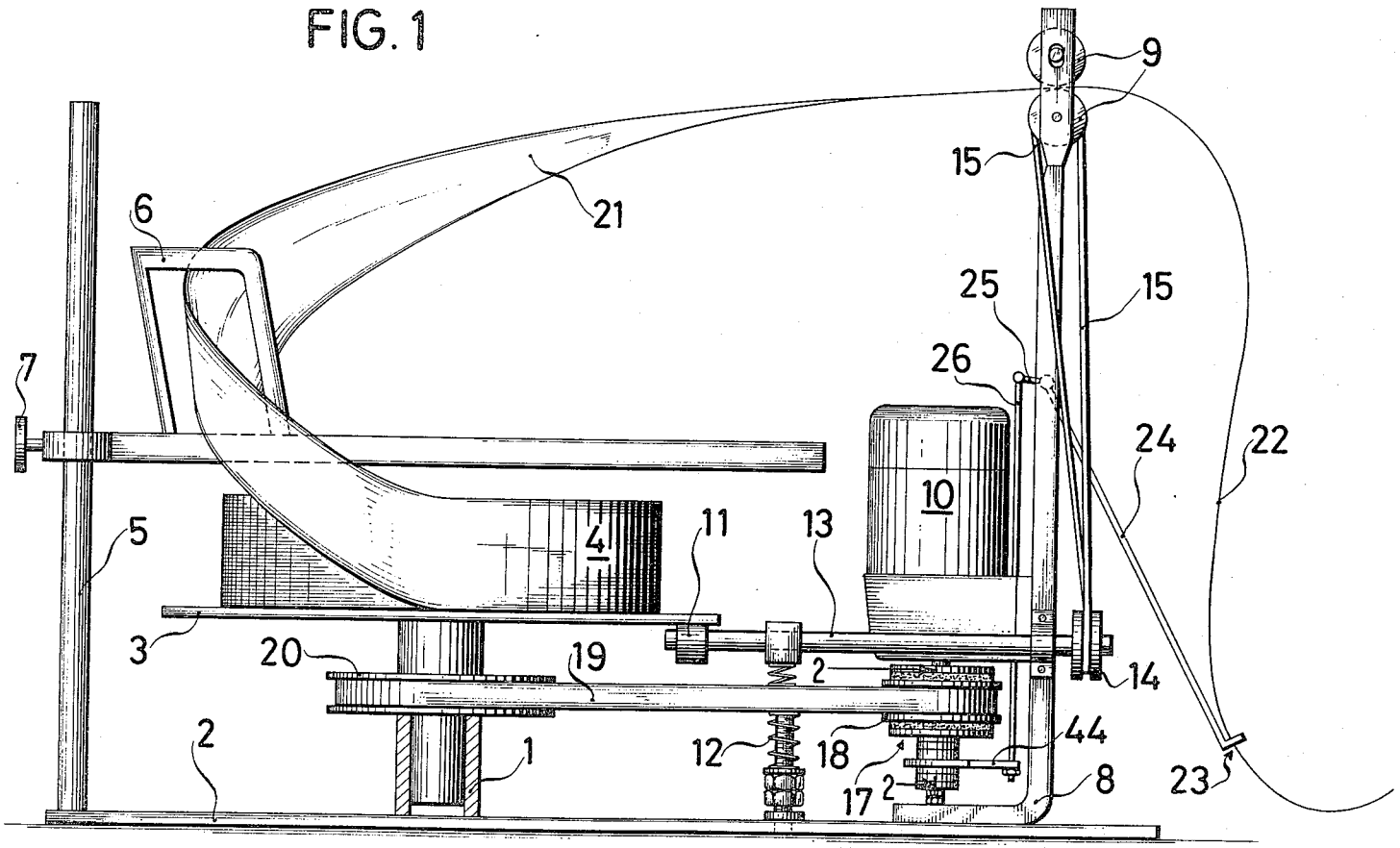
FIG. 1 is an elevation of an unreeling capstan.

The unreeling capstan according to FIG. 1 comprises a reel plate 3, on which is laid the material coil 4 to be reeled off and which is rotatably arranged with vertical axis of rotation over a bearing 1 on a base plate 2. Furthermore fastened to the base plate 2 is a guide rod 5 for the tape guide 6, which is pre-adjustable in the height and possibly in longitudinal direction and which is locatable by a clamping screw 7. The transport roller holder 8, which at its upper end carries the transport rollers 9, is arranged at the base plate 2 about diametrically opposite the guide rod 5. Also the drive motor 10 for the reel plate 3 as well as also the transport rollers 9 is flanged to this transport roller holder 8, while the drive of the transport rollers 9 takes place through a shaft 13, standing in operative connection through a friction roller 11 with the reel plate 3 and urged by a compression spring 12 against this, the belt pulley 14 arranged on the shaft 13, the V-belt 15 and the belt pulley 14 fastened to a transport roller 9. The drive of the reel plate 3 itself takes place through the belt pulley 18 arranged on the driving shaft 16 (FIG. 2) of the motor with the interposition of a slipping clutch 17, the belt 19 and the belt pulley 20 fastened to the reel plate 3 (details about the manner of effect are stated later).

The tape 21 to be reeled off is guided through the tape guide 6 above the reel plate 3 and introduced, turned through 90°, into the transport rollers 9 and then in a tape loop 22 brought in front of the not shown processing machine. A feeler 23, which is for example provided with a slot and which is pivotably fastened at the transport roller holder 8 through a lever 24, engages at the unreeled tape in the region of this tape loop 22. An eccentric lever 25, which in turn is articulatedly connected with the actuating lever 26 for the slipping clutch 17, is fastened at the upper end of the lever 24.

Figure 2:
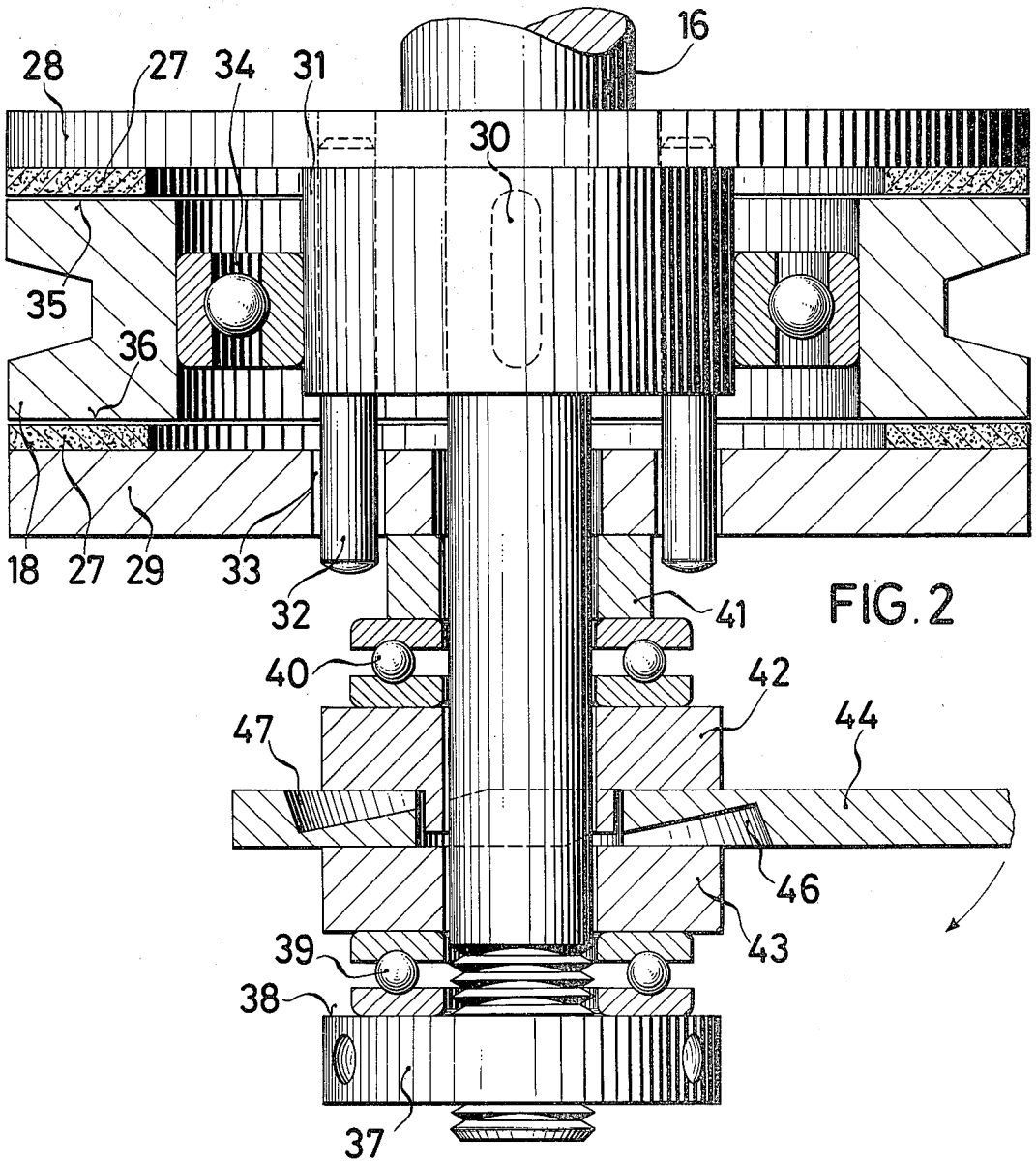
FIG. 2 is an enlarged scale of a cross-section through the driving unit with slipping clutch of the unreeling capstan according to FIG. 1.

The driving unit with the slipping clutch is illustrated to enlarged scale in FIG. 2. Two discs 28 and 29, which are provided with friction linings 27 and axially displaceable relative to each other, are arranged rotationally fast with the driving shaft 16 of the motor on the driving shaft 16 of the motor to both sides of the belt pulley 18 constructed as driving wheel. The one disc 28 displays a hub 31, which surrounds the driving shaft 16 of the motor, is connected rotationally fast therewith through an inserted wedge 30 and which carries axially extending projections or pins 32, which engages into corresponding recesses 33 of the second axially displaceable disc 29 and thus entrains this in circumferential direction. The belt pulley 18 is journalled to be freely rotatable in the uncoupled state through a rolling bearing 34 on the hub 31 of the disc 28, while this belt pulley 18 displays surfaces 35 and 36 lying opposite the friction linings 27 arranged on the discs 28 and 29 and bringable into operative connection with these.

A plate 44, which is guided through the axial rolling bearings 39 and 40 and spacer washers 41, 42, and 43 and which is connected through a radial projection with the actuating lever 26, is arranged between the axially displaceable disc 29 and an axial shoulder 38 formed by a spindle-bolt nut 37 or the like and connected fast with the end of the prolonged driving shaft 16 of the motor.

Figure 3:
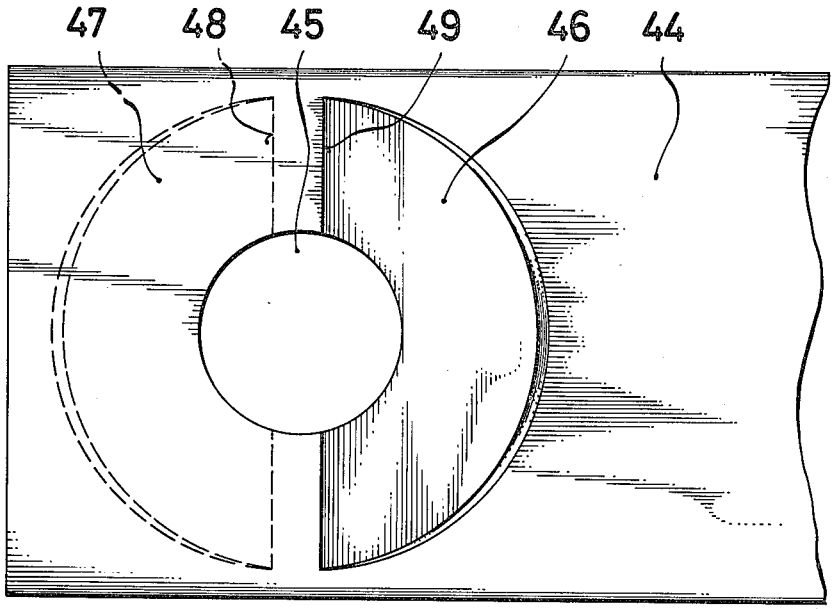
FIG. 3 is a plan view on to the plate serving as actuating device for the slipping clutch.

This plate 44 (as is evident from FIGS. 2 and 3) displays two semicircular milled recesses 46 and 47, which extend obliquely to the normal onto the plate and which lie diametrically opposite each other to both sides of the plate, in the region of the bore 45 penetrated by the driving shaft 16 of the motor. These milled recesses 46 and 47 form two knife edges 48 and 49, by which the plate 44 bears against the adjoining parts when the plate 44 is tilted through the actuating lever.

The manner of effect of the described device is the following: When the tape loop 22 reduces, the feeler 23 is moved upwardly in direction of the arrow. In that case, the lever 24 describes a pivotal motion, whereby the eccentric lever 25 connected with it presses the actuating lever 26 downwardly. Thereby, the plate 44 is pivoted in arrow direction (FIG. 2) around the knife edges 48 and 49 and, through the bearings 39 and 40 as well as the spacer washers 41 to 43, presses the axially movable disc 29 against the belt pulley 18 and against the disc 28 connected fast with the driving shaft 16 of the motor. The belt pulley 18 is entrained, with slip at first and free of slip on further pressing, through the friction linings 27, whereby the drive of the rotary plate takes place through the belt 19 and the belt pulley 20. Since the rotational speed of the motor has been chosen to be greater than corresponds to the tape speed at the inner diameter of the material coil, more tape material is unreeled from the reel plate in the case of slip-free drive of the belt pulley 18 than is consumed by the processing machine. This means that the tape loop 22 again enlarges, whereby the feeler 23 goes back and more or less strongly releases the slipping clutch through the lever linkage 24, 25, and 26 and thereby reduces the rotational speed of the belt pulley and finally of the reel plate so that a rotational speed sets in, which corresponds to the speed of the tape at the inlet into the processing machine.

When the processing machine is suddenly stopped through any kind of event or the tape loop becomes ever greater, then the feeler going downwardly actuates a brake (not shown illustrated) which brakes the reel plate and at the same time opens the slipping clutch 17. On restarting of the processing machine or shortening of the belt loop, the brake is again released and the slipping clutch brought in engagement so that the reel plate 3 is set into rotation and tape is unreeled.

In all these processes, the driving motor 10 rotates at constant rotational speed without it having to be switched off or controlled in its rotational speed. The friction arising on the slipping of the clutch between the frictional linings 27 and the oppositely disposed surfaces of the belt pulley 18 is extremely small just as the wear and hardly comes into consideration.

The invention is not restricted to the embodiment described in the preceeding. It is readily applicable also in unreeling reels with horizontal rotational axes or in such without special transport rollers. Also, no restrictions in the constructional development of the individual parts, such as control system or slipping clutch, are given. Rather, many modifications are possible, which shall not be listed in detail.

SUMMARY

In a reel for the unreeling of tapes or the like from a reel plate (3), which is driven by a driving motor (10), a gear, the driven wheel (18) of which is arranged on the driving shaft (16) of the motor and the driving wheel (20) of which is arranged on the shaft of the reel plate (3) and a clutch (17), which is controlled through a linkage by the unreeled tape, are provided between the driving motor (10) and the reel plate (3).

To make the constructional build-up and the operation simple and to assure a trouble-free and reliable operation with small performance losses, the clutch (17) as well as also the actuating device (44) for this clutch (17) as well as also the driven wheel (18) of the gear—the latter loosely and bringable into operative connection with this through the clutch (17)—arranged on the driving shaft (16) of the motor, wherein the actuating device (44) for the clutch (17) is connected through a lever system (24, 25, 26) with a feeler (23), which engages at the tape running off from the reel plate (3).

What is claimed is:

1. An apparatus for unreeling tapes and the like from reels which apparatus comprises a reel plate driven by a driving motor, said driving motor having a driving shaft provided with a driven wheel, said driven wheel connected via a transmission to a driving wheel, said driving wheel connected via a shaft to said reel plate, said driven wheel connected to a clutch, said clutch connected to an actuating feeler, said feeler engageable by tape unwound from a reel disposed on said reel plate whereby when said feeler is engaged said clutch is engaged to transmit rotation of said driven wheel to said driving wheel through said transmission.

2. An apparatus according to claim 1 wherein said transmission comprises a belt and each of said driving wheel and driven wheel comprise pulleys engaged by said belt.

3. An apparatus according to claim 1 wherein said transmission comprises a pair of gears.

4. An apparatus according to claim 1 wherein said clutch is a slipping clutch.

5. An apparatus according to claim 1 wherein on said driving shaft there are two discs relatively axially displaceable each of which are provided with friction linings, said discs connected rotationally fast to said driving shaft on both sides of said driven wheel.

6. An apparatus according to claim 4 wherein said actuating feeler is linkagely connected to an actuating device of said slipping clutch which actuating device comprises a plate bearing against an axial shoulder of said driving shaft of said motor which plate is in operative connection with an axially displaceable member of said slipping clutch.

7. An apparatus according to claim 6 wherein said plate has respective knife edges bearing against said axial shoulder of said driving shaft and against said axially displaceable member.

8. An apparatus according to claim 7 wherein said knife edges each have a semi-circular shape corresponding to a cooperatingly shaped recess extending obliquely to the normal onto said plate and lying diametrically opposite from both sides of said plate.

9. An apparatus according to claim 1 wherein said apparatus further comprises a brake controlled by unreeled tape for braking said reel plate.

10. An apparatus according to claim 9 wherein said brake is operatively connected to said feeler.

* * * * *